United States Patent [19]

Mansur, Jr. et al.

[11] 4,058,061

[45] Nov. 15, 1977

[54] EXPLOSIVE DEVICE

[75] Inventors: Dana L. Mansur, Jr., Garden Grove; Thomas L. Murphy, Los Gatos, both of Calif.

[73] Assignee: Aerojet-General Corporation, El Monte, Calif.

[21] Appl. No.: 558,335

[22] Filed: June 17, 1966

[51] Int. Cl.[2] ..... F42B 23/28

[52] U.S. Cl. ..... 102/8; 102/70 R

[58] Field of Search ..... 102/8, 56, 57, 70, 16, 102/18

[56] References Cited

U.S. PATENT DOCUMENTS

| | | | |
|---|---|---|---|
| 325,538 | 9/1885 | Hayes | 102/57 |
| 2,376,332 | 5/1945 | Adelman | 102/8 X |
| 2,399,242 | 4/1946 | Metcalfe | 102/8 |
| 2,402,552 | 6/1946 | Hopkins | 102/57 |
| 2,923,237 | 2/1960 | Bleikamp | 102/70 X |

*Primary Examiner*—David H. Brown

*Attorney, Agent, or Firm*—Edward O. Ansell

[57] ABSTRACT

This disclosure concerns an explosive device, such as a mine, which comprises a flexible enclosure having a pair of separate chambers formed therein. Substantially non-explosive liquids, which when mixed form a liquid explosive material, are respectively disposed in the chambers in separated relation to each other. A closure member is initially disposed so as to block an opening which provides communication between the chambers. Upon removing a latch mechanism holding the closure member in place,the closure member is moved away from the opening to permit mixing of the non-explosive liquids, thereby forming the liquid explosive material and arming the explosive device. A pressure-responsive igniter mechanism is disposed within the enclosure so as to be subject to the pressure condition of the liquid explosive material. The application of pressure to the flexible enclosure causing an increased pressure condition of the liquid explosive material actuates the igniter mechanism to detonate the liquid explosive material.

8 Claims, 3 Drawing Figures

INVENTORS
THOMAS L. MURPHY
DANA L. MANSUR, JR.
BY
Edward O. Anzell
George J. Hatter
ATTORNEYS

EXPLOSIVE DEVICE

The present application pertains generally to explosive devices, and more particularly, to such devices for use as mines.

Conventionally, a mine, irrespective of manner of deployment, consists of a quantity of high explosive packaged together with an igniter that is capable of being actuated by a vehicle or an individual tripping some sort of mechanical actuator. A matter of paramount importance is that the mines be constructed so that they can be handled safely prior to actual use without the risk of inadvertent detonation.

In addition, depending on the particular use for which a given mine was designed, the shape and overall construction of known mines is restrictive of their application for other uses, thereby increasing logistic expenses in producing and stocking multiple shapes and sizes of mines. Moreover, with mines of different fundamental constructions, corresponding modifications of the associated safety devices may be necessary in order to make them fully safe for handling during transportation and actual deployment.

It is therefore a primary object and aim of the present invention to provide an explosive device that offers the optimum in safe handling techniques prior to the time of its intended use.

Another object is the provision of an explosive device in which the explosive charge ingredients are in non-explosive condition prior to affirmative arming.

Yet another object is the provision of an explosive device that is pressure actuated.

Still another object is the provision of an explosive device that is relatively simple and inexpensive to construct and adaptable to wide variations of shapes and sizes.

Other objects and advantages of the invention will be manifest to those skilled in the art when referring to the accompanying drawings.

IN THE DRAWINGS

A fundamental aspect of the present invention is that the materials composing the explosive charge are not of themselves explosive until affirmative action is taken to make them so. This situation is obtained by using a so-called binary explosive as the basic charge, that is, a liquid explosive material produced on mixing of two certain other liquids that themselves are substantially non-explosive. An example of a binary explosive that is especially advantageous for use in this connection is the material sold under the registered trademark AEREX by the Aerojet-General Corporation, Azusa, Calif. When referencing the ingredients of a binary explosive in the description that follows, the letters A and B will be used to denote the separate liquid constituents.

Figure 1:
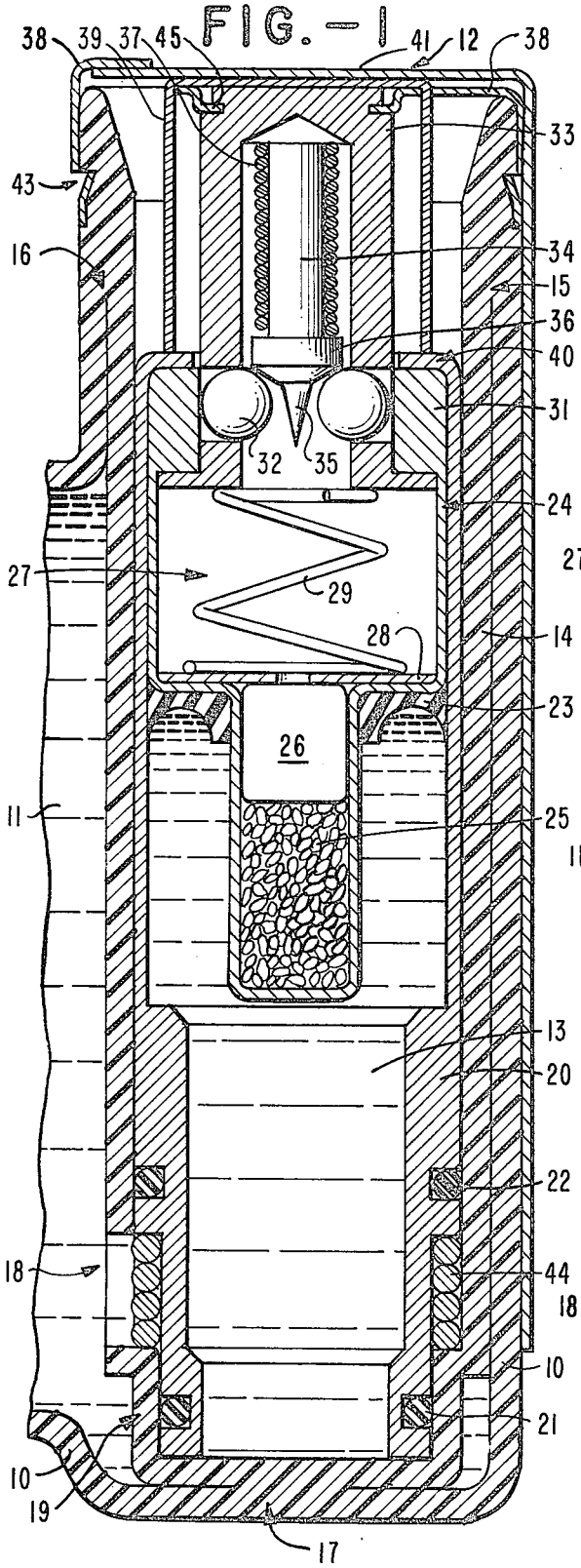
FIG. 1 is an elevational, partially fragmentary, sectional view of the device of the present invention showing it in the safe or unarmed condition.

Turning now particularly to FIG. 1, the device of the invention is substantially enclosed by a one-piece flexible plastic body wall 10. This wall is formed into a relatively large sack-like enclosure 11 for including a first, or A, material of the binary explosive charge, and a smaller region that contains the initiating mechanism 12 and a chamber 13 for the B liquid. Examples of satisfactory materials of which to make the body wall 10 are polyethylene or polypropylene, to name but two. As will be made clear from the description below, it is the general scheme of operation of this invention to provide first a mixing of the A and B fluids together to form the binary explosive charge and then on the application of a suitable amount of pressure anywhere onto the wall of the enclosure 11, ignition via the mechanism 12 is achieved, and thereby detonation of the binary explosive.

Integral with the wall 10 is a cylindrical member 14, which in FIG. 1 is shown in upright relation, composed of the same material as the wall 10 and joined therewith at 15, 16 and 17. A communicating opening 18 between the enclosure 11 and chamber 13 is formed in the member 14, and it is via this opening that mixing of the binary explosive materials is accomplished.

The lower end 19 of the cylindrical member 14 is of reduced circular cross-section and within which are received similarly dimensioned portions of a metal body 20. The upper portions of the body are of larger cross-section and slidingly fit within the upper reaches of the member 14. Thus, when disposed in the lowermost condition, the metal body 20 bottoms onto the wall 14 in the region of 17, and the upper portion of the opening 18 registers with that part of the metal body at which the cross-section area changes. A pair of O-ring seals 21 and 22, received within properly dimensioned grooves in the outer surface of the body 20, serve to seal off the inner parts of the cylindrical body from access of liquid A, as well as prevent liquid B from leaking out, when the body is at its lowermost position. This is important in that to maintain the safe, or non-explosive, condition, the constituent binary fluids must be kept separate prior to affirmative arming.

The lower approximately two-thirds of the inner volume of the body 20 defines the chamber 13 that contains the B liquid of the binary explosive. The upper limit of the chamber is partially formed by an annular gasket 23 having a concave surface facing downwardly. A can assembly 24 includes a booster 25 and igniter 26 at the lower end and an open-ended, hollowed out part 27 at the upper end.

A support plate 28 is restingly received within the hollowed out part of the assembly 24 in contacting relation to the igniter 26. This plate is a relatively thin metal disc that includes a central opening therethrough. A relaxed coil spring 29 rests on the plate 28 and extends upwardly therefrom to receive and support the lower flangelike portions of an actuator housing 33. These flangelike portions bear against appropriately shaped internal shoulders defined by a radially inwardly extending flange 31 integral with the can assembly 24. The actuator housing 33 is provided with a plurality of radially extending openings therethrough which are disposed in circumferentailly spaced relation to each other and adjacent to the lower flangelike portions of the housing 33. The radially extending openings in the housing 33 define pockets which respectively receive detent balls 32 therein. The radially inwardly extending flange 31 of the can assembly 24 is normally disposed in overlying registering relation to the pockets in the housing 33 so as to restrict the detent balls 32 against movement radially outwardly of their respective pockets.

Thus, the detent balls 32 partially protrude within the housing 33 when the flange 31 overlies the pockets in which the detent balls 32 are received. An elongated striker 34 is carried within the body 33, in substantially axial alignment therewith, and has a striker pin 35 at its lowermost end mounted on an enlarged head portion 36. A coil spring 37 is received on the striker 34 and compressingly loaded between a closed end surface of the housing 33 and the enlarged head portion 36. The coil spring37 biases the striker 34 so as to urge the enlarged head portion 36 thereof into engagement with the detent balls 32. A securing means 38 is anchored in the outer surface of the body wall 10 and the housing 33 to provide a fixed positional relationship between the two and, as will be gone into more fully later herein, simultaneously acts as an upper limit stop for movement of the body 20.

A U-shaped clip 39 is disposed over the striker 34 with its open edges resting on the upper surface of turned-in portions 40 of the body 20. A lanyard 41 consisting of a generally L-shaped metal member, with the short arm portion extending over the top of the device and coextensive with the closed end of the clip 39 and the long arm coextensive with the outer surface of the wall 10, serves to hold the clip 39 in position against the portions 40 and thereby maintain the body 20 at its lowermost position. The securing means 38 is affixed to the plastic wall 10 by a crimped edge 43, for example, and holds the short arm of the lanyard 41 in place on the device. No means are shown for holding the long arm of the lanyard in place. However, this can be done in any one of a number of different ways, either individually or in a special packaging arrangement where a plurality of devices are deployed aerially via a unit container, for example.

It is seen that the coiled spring 44 received in surrounding relationship on the small diameter section of the body 20 tends to urge the body upwardly. However, due to the retaining action of the lanyard via the clip 39 onto the upper extremity of the body 20, the spring 44 is unable to produce upward movement of the body 20. Also, the spring 37 which tends to urge the striker 34 downwardly is unable to do so because of the action of the detent balls 32 bearing against the enlarged head portion 36 of the striker 34.

Figure 2:
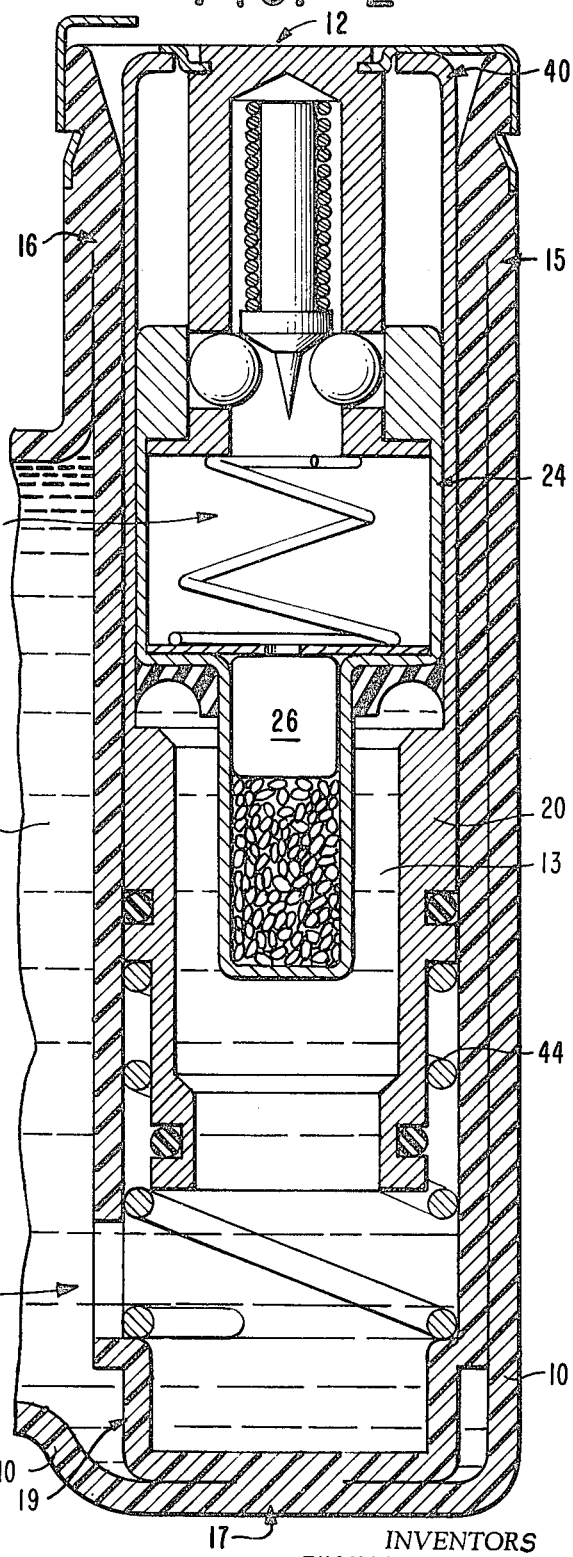
FIG. 2 is a view similar to that of FIG. 1 with the device illustrated in armed condition.
Figure 3:
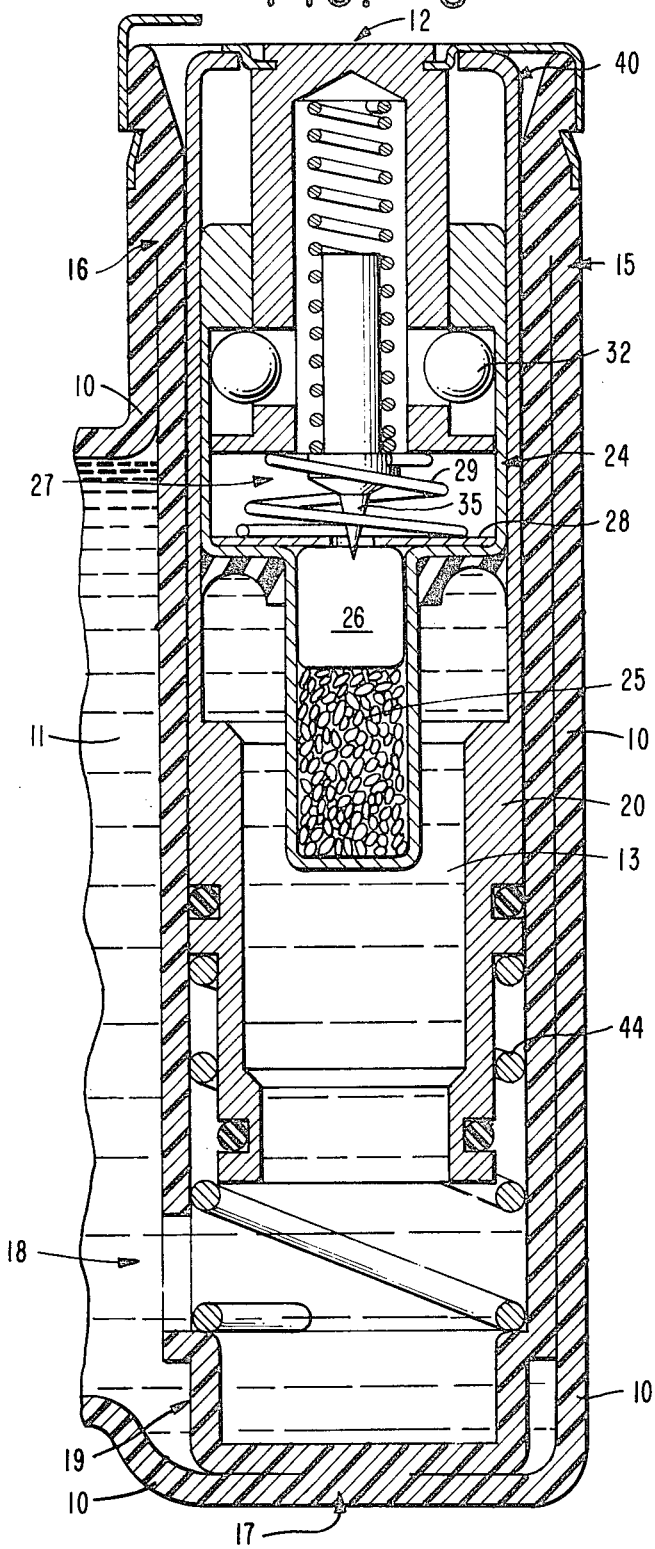
FIG. 3 is a view similar to that of FIG. 2 illustrating ignition.

To place the explosive device in the armed condition as shown in FIG. 2, all that is required is the removal or release of the lanyard 41. When this is accomplished, the clip 39 is not secured against movement upwardly, and the spring 44 is free to extend itself, driving the body 20 upwardly (throwing off the clip 39) until the turned-in portions 40 of the body 20 engage securing clips 38 and 45. As a result of this upward movement of the body 20, the opening 18 is uncovered so as to provide communication between the enclosure 11 and chamber 13, thereby effecting mixing of the A and B liquids to form a detonatable binary explosive. The device is now in the armed condition.

Detonation of the device is accomplished whenever pressure is applied to the flexible wall 10. When this happens, hydraulic pressure is exerted throughout the entire liquid which acts upwardly against the gasket 23 driving the can assembly 24 upwardly. The detent balls 32 are now movable radially outwardly into the space so provided where the flange 31 of the can assembly 24 formerly was located. With removal of the detenting action of the balls 32, the spring 37 now drives the striker 34 downwardly, and the striker pin 35 passes through the central opening in the plate 28 to actuate the igniter 26, with the igniter 26 then igniting the booster 25, and the booster 25 detonating the main charge comprising the mixture of liquids A and B.

In the foregoing description, reference has been made to use of an explosive material having two relatively non-explosive liquid ingredients, e.g. the so-called oxidizer and sensitizer liquids of AEREX. It is considered within the spirit of this invention that three or more non-explosive constituent liquids may be employed so as to form the explosive material when mixed together. Also, certain constituents can be solid in form and when mixed with liquid constituents, may either go into suspension or be dissolved in forming the explosive material.

While a particular embodiment of the invention has been illustrated and described, it will be understood that the invention should not be construed as being limited thereto, but only to the lawful scope of the appended claims.

We claim:

1. An explosive device comprising: a flexible sealed enclosure, partition means within the enclosure forming at least two separate chambers, non-explosive ingredients of an explosive material being separately disposed in the respective chambers, means operatively related to the partition means for providing open communication between the chambers to effect mixing of the ingredients forming the explosive material; and igniter means carried by the enclosure for detonating the explosive material, said igniter means including a striker assembly, an igniter-booster charge, detent means securing the striker assembly against movement, and means actuatable by an increased pressure condition of the explosive material to release the detent means from securing relation to the striker assembly, thereby causing the striker assembly to move against the igniter-booster charge to set off the igniter-booster charge and detonate the explosive material.

2. An explosive device as in claim 1, in which the striker assembly includes a member having a piercing part, the member being spring-loaded to urge movement of the member and the piercing part thereof toward the igniter-booster charge, and the detent means including at least a pair of ball elements in securing relation to the striker assembly, and the means to release the detent means including a member disposed in surrounding confining relation to the pair of ball elements and normally retaining the pair of ball elements in securing relation to the striker assembly but movable away from confining relation to the pair of ball elements in response to an increased pressure condition of the explosive material to release the pair of ball elements from securing relation to the striker assembly, whereby the spring-loaded member and the piercing part thereof are moved to dispose the piercing part in operative relation with the igniter-booster charge to ignite the igniter-booster charge.

3. An explosive device comprising: a sealed enclosure having a pair of separate chambers and at least one common wall therebetween, non-explosive ingredients of a fluid explosive material being separately disposed in the respective chambers, said common wall having an opening therein for providing communication between the pair of chambers, a closure member blocking the opening in said common wall to initially prevent communication between the pair of chambers, means biasing said closure member to a position clear of said opening, removable latching means retaining said closure member in blocking relation to the opening, said closure member being movable by said biasing means to clear said opening for providing communication between the pair of chambers to affect mixing of the ingredients forming the explosive material in response to the removal of said latching means, igniter means carried by the enclosure for detonating the explosive material, and pressure-responsive means responsive to increase in pressure of the fluid explosive material for actuating the igniter means.

4. An explosive device as set forth in claim 3, wherein said igniter means comprises a tubular member having a closed end which defines a portion of one chamber, the opposite end of said tubular member being open and terminating in a radially inwardly extending flange, a housing extending within the open end of said tubular member and being provided with a plurality of radial pockets therethrough, detent members respectively mounted in said pockets, said radially inwardly extending flange at the open end of said tubular member being disposed in overlying registering relation to the pockets restricting said detent members against movement radially outwardly of their respective pockets, said detent members respectively projecting radially inwardly with respect to their pockets and partially protruding within said housing, an elongated striker disposed in said housing, said elongated striker having a shoulder thereon defining a cam surface, means biasing said striker in a direction forcing the cam surface thereon into engagement with the detent members partially protruding within said housing so as to retain said striker in a retracted position, and pyrotechnic igniter material disposed in the closed end portion of said tubular member in spaced alignment with said striker; and said tubular member being movable in a direction disposing said radially inwardly extending flange at the open end thereof out of registration with the pockets in said housing in response to an increased pressure condition of the explosive material within the pair of chambers acting against the closed end of said tubular member, whereby the detent members are cammed radially outwardly by the cam surface of said striker under the influence of said biasing means to release said striker so that said striker may be urged by said biasing means into contact with said pyrotechnic igniter material to set off said pyrotechnic igniter material for detonating the explosive material.

5. An explosive device as in claim 3, in which the non-explosive ingredients comprise first and second liquids separately disposed in the respective chambers and which on mixing form a binary liquid explosive material.

6. An explosive device as in claim 5, in which the igniter means is disposed in one of the chambers and the pressure responsive means contacts the liquid therein, whereby an increase of the liquid pressure to a predetermined magnitude actuates the igniter means and detonates the liquid explosive material.

7. An explosive device comprising a sealed enclosure defining a cavity having a flexible wall, a fluid explosive material disposed within said cavity, a striker within said enclosure, pyrotechnic igniter material disposed within said enclosure in spaced relation to said striker, bias means biasing said striker towards the pyrotechnic igniter material, retaining means retaining said striker in a retracted position spaced from the pyrotechnic igniter material, and pressure-operable means responsive to an increase in pressure of said explosive material for releasing said striker from said retaining means, whereby upon an increase in pressure on said flexible wall the pressure condition of the explosive material increases within said cavity to operate on said pressure-operable means thereby releasing said striker from said retaining means to permit said bias means to urge said striker into contact with said pyrotechnic igniter material to ignite said pyrotechnic material for detonating the explosive material.

8. An explosive device as in claim 7, in which the enclosure is constructed of a flexible synthetic plastic material.

* * * * *